US005163516A

United States Patent [19]

Palmatier

[11] Patent Number: 5,163,516

[45] Date of Patent: Nov. 17, 1992

[54] CHIMNEY SAFETY SYSTEM

[75] Inventor: Jon Palmatier, Binghamton, N.Y.

[73] Assignee: Gilbert Machine & Tool Company, Inc., Greene, N.Y.

[21] Appl. No.: 735,567

[22] Filed: Jul. 25, 1991

[51] Int. Cl.[5] ..... A62C 3/04

[52] U.S. Cl. ..... 169/54; 169/57

[58] Field of Search ..... 169/57, 58, 46, 54

[56] References Cited

U.S. PATENT DOCUMENTS 4,260,023 4/1981 Irmscher ..... 169/57
4,384,617 5/1983 Mueller ..... 169/57

FOREIGN PATENT DOCUMENTS 461533 12/1949 Canada ..... 169/57
1454485 1/1989 U.S.S.R. ..... 169/57

*Primary Examiner*—Margaret A. Focarino
*Assistant Examiner*—Gary C. Hoge
*Attorney, Agent, or Firm*—Salzman & Levy

[57] ABSTRACT

The present invention features a chimney fire safety device that attacks a chimney fire by a multi-stage application of flame extinguishing compounds. The extinguishing compounds are disposed in a nested envelope, one-within-the-other. Each compound mass is enclosed in a fusible, time-release membrane, and the encased compounds are nested within each other, such that the fire extinguishing applications are sequentially applied one after the other at ever closer positions relative to the source of the fire. The compound mass rests upon, or is confined by, a platform at the top of a chimney or wood burning stove flue. The platform is designed to collapse, thus dropping the chemicals upon the fire. A fusible link melts under the higher temperature of an uncontrolled fire, thus collapsing the platform and releasing the chemical extinguisher. An alarm or flag warning is also triggered in response to the melting of the fusible link.

20 Claims, 3 Drawing Sheets

CHIMNEY SAFETY SYSTEM

FIELD OF THE INVENTION

The invention relates to chimney safety devices and more particularly to a multi-stage chimney safety system that automatically and progressively extinguishes a chimney fire or runaway wood burning stove fire that is out of control. The invention battles such fires in sequential stages and provides both an alarm and a signal for summoning fire fighting authorities.

BACKGROUND OF THE INVENTION

The art of fire fighting is as old as man. Chimney and wood burning stove fires have presented many problems over the ages.

In the art of fire fighting, it has always been traditional to blanket the fire at its base with as much fire fighting chemicals as is possible, as fast as is possible. In other words, if you have two fire extinguishers, the rule is to use both simultaneously upon the base of the fire rather than to use each extinguisher sequentially.

While this is still the rule for most if not all fires, it has never worked too well with chimney or wood burning stove fires. There have been many attempts to provide a workable chimney fire device, unfortunately with less than total success. Despite all the thought and research given to the problem, chimney fires still persist and cause a great deal of damage to property.

This invention reflects the discovery that the traditional fire fighting rules do not apply to the battle of chimney fires. Dumping all the fire fighting chemicals upon the fire at once is seldom the best solution. The invention notes that most chimney fires are already rapidly raging fires, since they spring from an intense fire that was previously and normally contained within the hearth. Dumping a great amount of extinguisher chemicals upon a chimney fire has not been effective because the rapidly raging fire produces an enormous draft (Venturi effect) that blows most of the chemicals back up and out of the chimney. Therefore, only a small amount of the chemical extinguisher is actually ever brought to bear against the blaze. In addition, most chemicals that are dumped on a chimney blaze are dropped from above the fire and are usually swept upward by the draft. These chemicals never reach the base of the blaze. Therefore, it should have become obvious that dumping large amounts of chemical all at once from a predetermined height was not an effective remedy for this type of fire.

The invention capitalizes on the principle that the best procedure for fighting a chimney or wood burning stove fire is to first slow the fire down with an initial extinguishing charge released from a relatively distant position. Then, a second charge or additional repeated charges can be introduced at ever closer positions to extinguish the remaining, crippled fire. In other words, the present invention is based upon an opposite fire fighting theory than the one traditionally held by the fire fighting experts.

The current invention suggests a sequential or multi-stage fire fighting approach towards combating chimney fires.

DISCUSSION OF RELATED ART

In U.S. Pat. No. 4,384,617, issued to Mueller on May 24, 1983, for "Chimney Fire Prevention Device and Tar Trap," a sealed fire fighting device disposed on the top of a chimney is illustrated.

The device uses a dry chemical, such as baking soda, that is further weighted by sand. A plastic sheet partition maintains the chemical in a suspended state until a temperature is reached in the escaping gases that melts the plastic sheet partition. Upon melting of the partition, the chemical is allowed to drop upon the fire.

In U.S. Pat. No. 4,260,023, issued to Irmscher on Apr. 7, 1981, for "Automatic Fire Extinguisher for Chimneys Having a Float Operated Flag," a fire fighting device that dumps water upon a chimney fire is illustrated. A warning flag is actuated with the discharge of the water upon the flames.

In U.S. Pat. No. 2,011,803, issued to Dube on Aug. 20, 1935, for "Fire Extinguisher," a water reservoir is shown mounted on top of a chimney. The water in the reservoir is released when a fusible link melts, which in turn allows a weight to drop and pull upon a lever attached to a drain plug of the reservoir. An alarm is also sounded when the lever releases the drain plug.

SUMMARY OF THE INVENTION

In accordance with the present invention, there is provided a chimney fire safety device that attacks a chimney fire by a multi-stage application of flame extinguishing compounds. The extinguishing compounds are disposed in a nested envelope, one-within-the-other. Each compound mass is enclosed in a fusible, time-release membrane and the encased compounds are nested within each other, such that the fire extinguishing applications are sequentially applied one after the other at ever closer positions relative to the source of the fire. The compound mass rests upon, or is confined by, a platform at the top of a chimney or wood burning stove flue. The platform is designed to collapse, thus dropping the chemicals upon the fire. A fusible link melts under the higher temperature of an uncontrolled fire, thus collapsing the platform and releasing the chemical extinguisher. An alarm or flag warning is also triggered in response to the melting of the fusible link.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a multi-staged fire safety device for chimney or wood burning stove fires. A dangerous or runaway fire in a chimney or wood burning stove flue is treated at ever closer positions relative to the fire with a sequential mix of time-release chemical agents to bring the fire under control. The fire extinguishing compounds are nested within each other and each is enclosed within a time-release membrane. When the chemical agents are dumped upon a dangerous fire, each agent acts in turn to bring the fire under control.

For the purposes of brevity, like elements and components will have the same designation throughout the figures.

Figure 1:
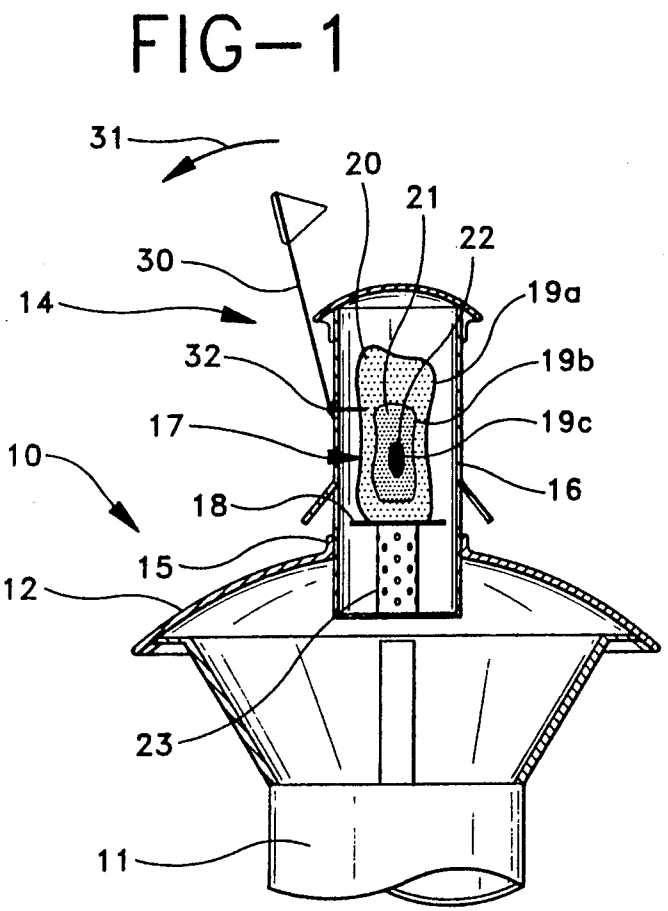
FIG. 1 is a schematic, sectional view of the top of a chimney or flue, wherein the fire safety device of the invention is shown mounted in situ.

Now referring to FIG. 1, a top portion 10 of a chimney or flue 11 is shown. The top portion 10 is shown as a domed canopy 12, but obviously other types of chimney configurations are known and will work just as well with the invention. The canopy 12 is modified to hold the fire safety device 14 of this invention. The fire safety device 14 comprises a housing 16 that rests within a cylindrical aperture 15 provided in the top of canopy 12.

A mass of fire extinguisher chemicals 17 is shown resting upon a platform 18 within housing 16. The mass of chemicals 17 is contained within several membrane envelopes 19*a*, 19*b*, 19*c*, etc., each weighted and nested within each other. Each of the membrane envelopes 19*a*, 19*b*, 19*c*, etc., comprises time-release materials that melt away under heat and allow the chemicals to mix with the hot gases and combustibles of the fire. Moreover, each membrane also encloses a chemically inert weight for counteracting the Venturi updraft effect that often acts to inhibit the extinguisher chemicals 17 from moving downward.

Each membrane is designed to release its contained substances at a different time, such that there is a steady, progressive, sequential stream of chemicals being fed to the fire. Each of the chemicals begins operation where the previous chemical left off, in order to extinguish the fire in a progressive manner. For example, the first compound 20, held within membrane 19*a*, can be a dry chemical such as sodium bicarbonate or baking soda. The membrane 19*a* is designed to melt almost immediately upon contact with the hot flue gases, such that the sodium bicarbonate is showered upon the blaze to slow the progress of the fire and diminish its intensity. The sodium bicarbonate drops to the bottom of the chimney due to the weight of its mass and that of the other weighted charges 21 and 22 contained therein. The sodium bicarbonate acts directly at the base of the fire, greatly diminishing its intensity and setting the stage for the other chemicals to act.

The second chemical compound 21 held within membrane 19*b* is an intumescent chemical that absorbs the heat of the fire and continues to snuff it out. Such an intumescent chemical for this purpose can be a chemical composition similar to that shown in U.S. Pat. No. 4,588,523, issued to Tashlick et al on May 13, 1986. Chemical compound 21 takes over after membrane 19*b* is caused to melt, which is designed to be about one-half minute after the application of the sodium bicarbonate. By this time, the charge 21 and its associated membrane 19*b* have moved to a closer position relative to the fire.

After chemical composition 21 has acted upon the fire, the third chemical agent 22 is released, from an even closer position relative to the fire, when membrane 19*c* is caused to melt. Membrane 19*c* is designed to melt about one minute after membrane 19*b* has melted. Chemical agent 22 can be a salt of hydration, such as sodium sulfate decahydrate. Upon heating, each molecule of chemical agent 22 releases ten molecules of water in order to cool the blaze. The heat necessary to disassociate the water molecules also rapidly cools the fire to the point where the blaze is under control.

The total mass of chemicals 17 resting upon platform 18 is not released under normal flue conditions, due to a heat absorbing shield 23 disposed directly below platform 18.

When a dangerous fire condition occurs, as when a fire starts to run away, the temperature of the flue gases starts to increase to around 600° F. At this point, the platform 18 can be caused to collapse by the melting of a fusible link made of Wood's metal (as is shown in greater detail with respect to the embodiment shown in FIG. 2), or the platform 18 itself may be of a material that is designed to melt upon experiencing the excessive temperatures.

When the chemicals 17 are released, a spring loaded flag 30 can be caused to pivot (arrow 31) about pivot pin 32, in order to signal that a dangerous fire is in progress.

Figure 2:
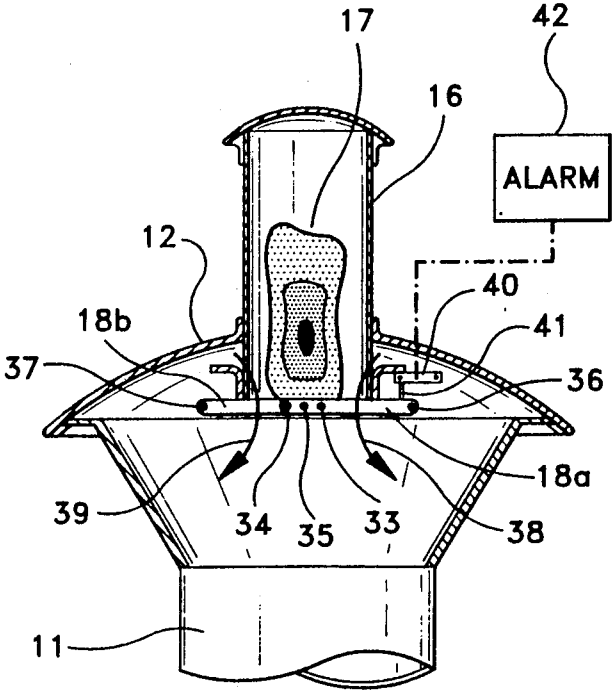
FIG. 2 is a schematic, sectional view of the top of a chimney or flue, wherein a first alternate embodiment of the fire safety device of FIG. 1 is mounted in situ.
Figure 3:
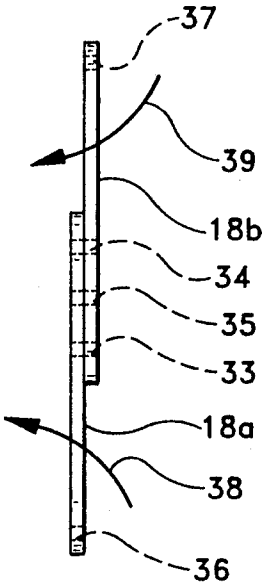
FIG. 3 is a bottom view of the platform depicted in the fire safety device shown in FIG. 2.

Referring to FIGS. 2 and 3, the housing 16 is shown with chemical mass 17 resting upon platform 18, as before. Platform 18 comprises two arms 18*a* and 18*b*, held together by three fusible link pins 34, 35 and 36, respectively. Under the high temperature of a runaway fire, fusible link pins 34, 35 and 36 melt to release the bond between arms 18*a* and 18*b*. When this happens, arm 18*a* is caused to pivot (arrow 38) about pivot pin 36 and arm 18*b* is caused to pivot (arrow 39) about pivot pin 37. As arms 18*a* and 18*b* swing open (arrows 38 and 39), the chemical mass 17 is caused to descend down the flue to attack the fire.

At the same time that the platform 18 collapses, a limit switch 40, whose pin 41 was resting against arm 18*a* in the open position, is released to activate alarm 42.

Figure 4:
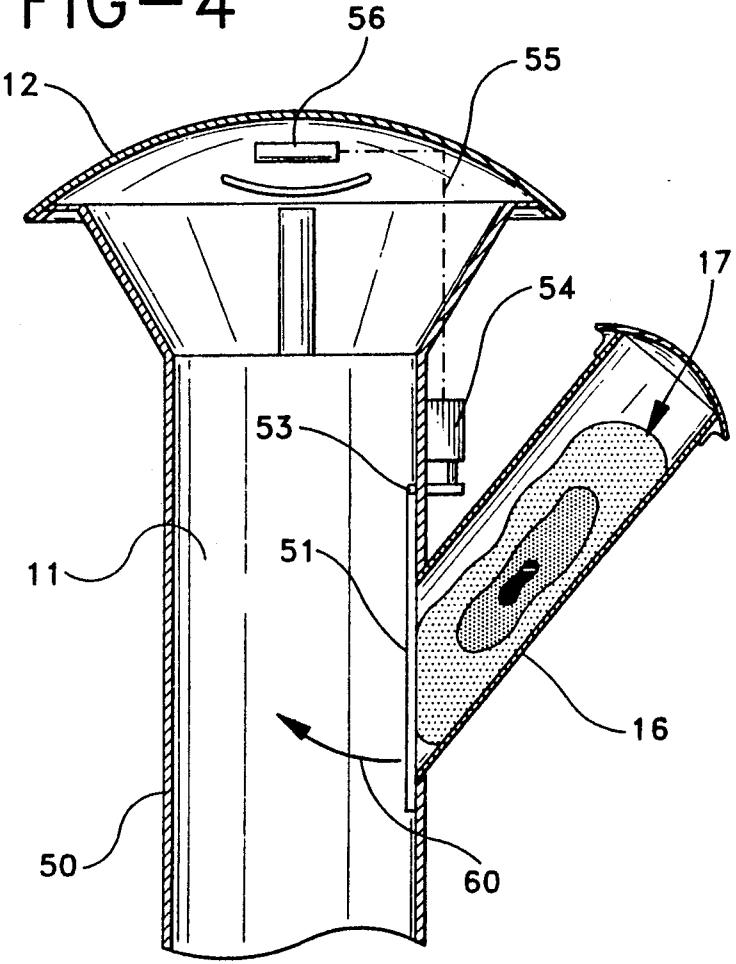
FIG. 4 is a schematic, sectional view of the top of a chimney or flue, wherein a second alternate embodiment of the fire safety device of the invention shown in FIG. 1 is mounted in situ.

Referring to FIG. 4, another alternate embodiment of the fire safety device of the invention is shown. In this embodiment, housing 16 is disposed on side 50 of the flue, as illustrated. The mass of chemicals 17 rests upon and is held in place by a door 51, which is pivotably spring loaded to swing open (arrow 60) about pivot pin 53. A solenoid switch 54 acts to release the spring-loaded door 51 upon a fire signal received over line 55 from heat sensor 56. When the door 51 swings open (arrow 60), the chemical mass is caused to slide out of housing 16 and down into the flue 11.

Figure 5:
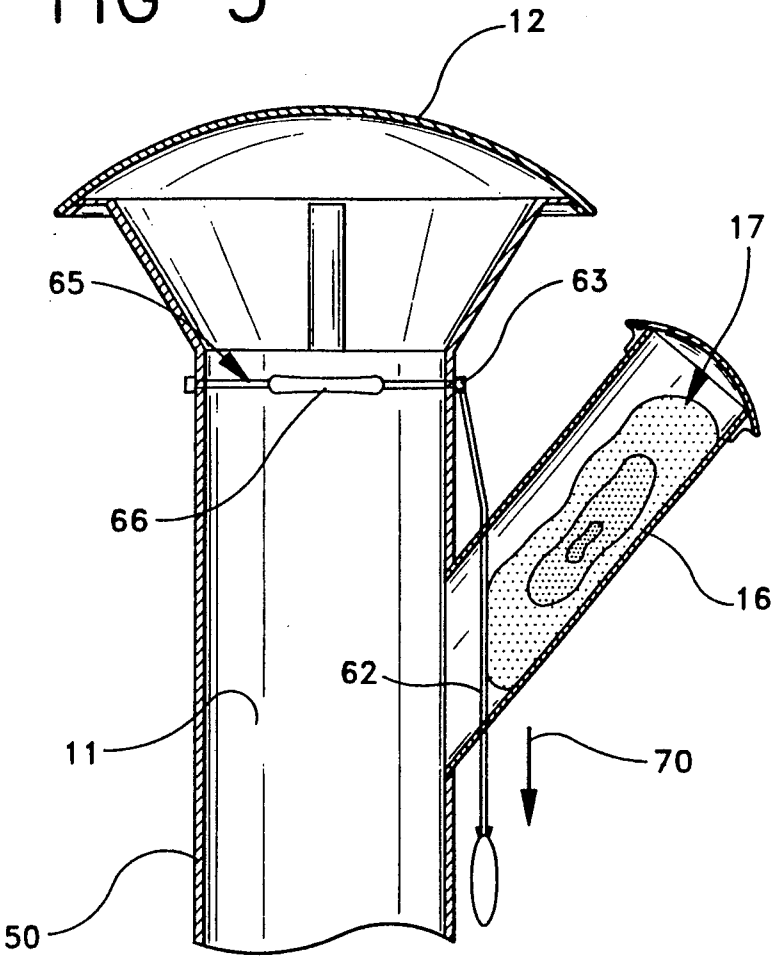
FIG. 5 is a schematic, sectional view of the top of a chimney or flue, wherein a third alternate embodiment of the fire safety device of the invention shown in FIG. 1 is mounted in situ.

Referring to FIG. 5, still another embodiment of the fire safety device of the invention is illustrated. The housing 16 is again disposed on side 50 of the flue 11. The chemical mass 17 is held in place by means of a weighted partition 62. The weighted partition 62 is connected to a fusible membrane 65 at point 63. The fusible portion 66 of fusible membrane 65 is caused to melt under dangerous fire conditions, thus allowing the weighted partition 62 to slip downwardly (arrow 70). When the partition 62 drops, the chemical mass 17 is free to slide into the flue 11.

Figure 6:
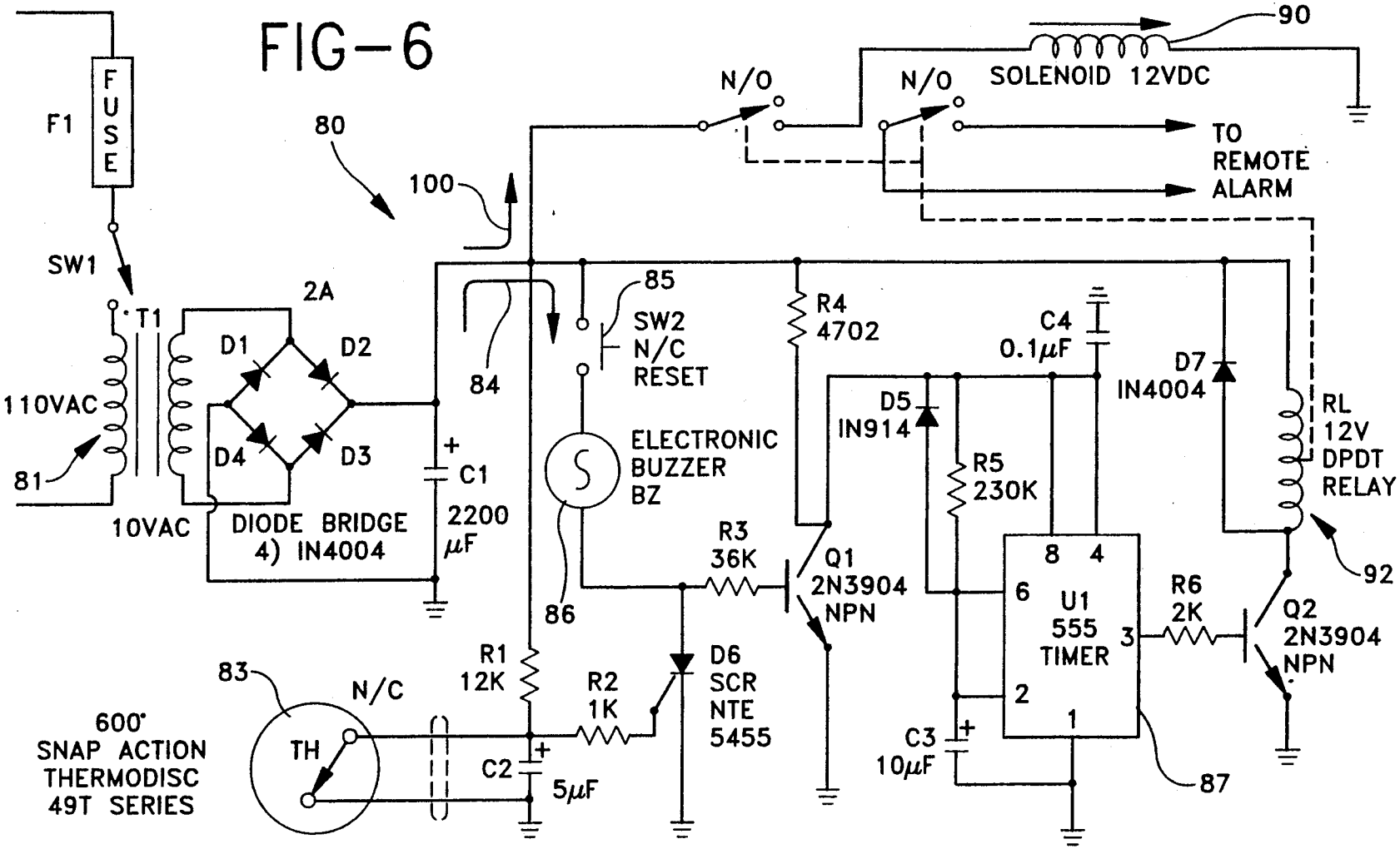
FIG. 6 depicts a circuit utilized in conjunction with the fire safety device of the invention shown in FIGS. 1 through 5, for signalling the presence of a dangerous fire.

Any one of the embodiments illustrated in the aforementioned figures can activate an alarm or send a signal for assistance. A circuit 80 shown in FIG. 6 can be utilized to provide the necessary warnings. Circuit 80 is powered by house current through transformer 81. A bridge of rectifiers 82 causes capacitors $C_1$ and $C_2$ to charge. When a dangerous fire condition takes place, the thermodisc 83 is caused to rupture, sending current (arrow 84) from capacitor $C_1$ through reset switch 85 through the electronic buzzer 86 through SCR to ground. The timer 87, acting through grounded transistors $Q_1$ and $Q_2$ can delay the activation of buzzer 86 by slowing the current drain through the SCR.

Current (arrow 100) can also be made to pass through a solenoid 90 that actuates a remote alarm. The relay 92 can be used to operate a telephone dialing device for calling the fire department.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the current invention, what is desired to be protected by Letters Patent is presented by the subsequently appended claims.

What is claimed is:

1. A chimney fire safety device that attacks a chimney fire by a multi-stage application of flame extinguishing compounds, comprising:

a mass of extinguishing compounds disposed within nested envelopes within a chimney, one-within-the-other, each extinguishing compound in said mass being enclosed in a fusible, time-release membrane and the membrane enclosed compounds being nested within each other, each of said envelopes enclosing a weight such that the fire extinguishing applications to a fire are sequentially applied one after the other at ever decreasing distances from the source of said fire;

support means for carrying said mass of extinguishing compounds until a dangerous or runaway fire condition develops in said chimney; and sensing means operatively connected to said support means and operative to sense a dangerous or runaway fire condition, said sensing means causing said support means to release said extinguishing chemicals upon said fire in response to the sensing of said dangerous or runaway fire condition.

2. The chimney fire safety device that attacks a chimney fire by a multi-stage application of flame extinguishing compounds in accordance with claim 1, wherein said mass of extinguishing compounds comprises at least one compound nested within another compound and separated by a time-release membrane.

3. The chimney fire safety device that attacks a chimney fire by a multi-stage application of flame extinguishing compounds in accordance with claim 1, wherein said mass of extinguishing compounds comprises at least one compound nested within a second compound that is nested within a third compound, each of said compounds being enveloped by a time-release membrane.

4. The chimney fire safety device that attacks a chimney fire by a multi-stage application of flame extinguishing compounds in accordance with claim 1, wherein said support means comprises a collapsible platform.

5. The chimney fire safety device that attacks a chimney fire by a multi-stage application of flame extinguishing compounds in accordance with claim 1, wherein said sensing means comprises at least one fusible link.

6. The chimney fire safety device that attacks a chimney fire by a multi-stage application of flame extinguishing compounds in accordance with claim 1, further comprising an alarm operatively connected to said sensing means, said alarm being activated when said sensing means causes said support means to release said extinguishing chemicals upon said fire.

7. The chimney fire safety device that attacks a chimney fire by a multi-stage application of flame extinguishing compounds in accordance with claim 1, further comprising a circuit for sending an alarm signal calling for assistance, said circuit being operatively connected to said sensing means, said circuit signalling assistance when said sensing means causes said support means to release said extinguishing chemicals upon said fire.

8. The chimney fire safety device that attacks a chimney fire by a multi-stage application of flame extinguishing compounds in accordance with claim 1, wherein said support means comprises a slidable partition.

9. The chimney fire safety device that attacks a chimney fire by a multi-stage application of flame extinguishing compounds in accordance with claim 1, wherein said support means comprises a pivotable partition.

10. A chimney or flue fire safety device that attacks a chimney or flue fire by a multi-stage application of flame extinguishing compounds, comprising:

a mass of extinguishing compounds disposed within nested envelopes within a chimney, one-within-the-other, each extinguishing compound in said mass being enclosed in an envelope comprising a fusible, membrane, said membrane enclosed compounds being nested within each other such that each is sequentially applied to a fire one after the other;

support means for carrying said mass of extinguishing compounds until a dangerous or runaway fire condition develops in said chimney; and sensing means operatively connected to said support means and operative to sense a dangerous or runaway fire condition, said sensing means causing said support means to release said extinguishing chemicals upon said fire in response to the sensing of said dangerous or runaway fire condition.

11. The chimney or flue fire safety device that attacks a chimney or flue fire by a multi-stage application of flame extinguishing compounds in accordance with claim 10, wherein said mass of extinguishing compounds comprises at least one compound nested within another compound and separated by a time-release membrane.

12. The chimney or flue fire safety device that attacks a chimney or flue fire by a multi-stage application of flame extinguishing compounds in accordance with claim 10, wherein said mass of extinguishing compounds comprises at least one compound nested within a second compound that is nested within a third compound, each of said compounds being enveloped by a time-release membrane.

13. The chimney or flue fire safety device that attacks a chimney or flue fire by a multi-stage application of flame extinguishing compounds in accordance with claim 10, wherein said support means comprises a collapsible platform.

14. The chimney or flue fire safety device that attacks a chimney or flue fire by a multi-stage application of flame extinguishing compounds in accordance with claim 10, wherein said sensing means comprises at least one fusible link.

15. The chimney or flue fire safety device that attacks a chimney or flue fire by a multi-stage application of flame extinguishing compounds in accordance with claim 10, further comprising an alarm operatively connected to said sensing means, said alarm being activated when said sensing means causes said support means to release said extinguishing chemicals upon said fire.

16. The chimney or flue fire safety device that attacks a chimney or flue fire by a multi-stage application of flame extinguishing compounds in accordance with claim 10, further comprising a circuit for sending an alarm signal calling for assistance, said circuit being operatively connected to said sensing means, said circuit signalling assistance when said sensing means causes said support means to release said extinguishing chemicals upon said fire.

17. The chimney or flue fire safety device that attacks a chimney or flue fire by a multi-stage application of flame extinguishing compounds in accordance with claim 10, wherein said support means comprises a slidable partition.

18. The chimney or flue fire safety device that attacks a chimney or flue fire by a multi-stage application of flame extinguishing compounds in accordance with claim 10, wherein said support means comprises a pivotable partition.

19. A method for attacking a chimney or flue fire by a multi-stage application of flame extinguishing compounds, comprising the steps of:

placing a mass of extinguishing compounds disposed within nested envelopes within a chimney, one-within-the-other, each extinguishing compound in said mass being enclosed in an envelope comprising a fusible membrane, said membrane enclosed compounds being nested within each other such that each can be sequentially applied to attack a fire in a one after the other fashion; and releasing each extinguishing compound sequentially to attack a fire, such that each is released upon said fire one after the other in a timed sequence.

20. The method for attacking a chimney or flue fire by a multi-stage application of flame extinguishing compounds in accordance with claim 19, wherein said mass of extinguishing compounds comprises at least one compound nested within another compound and separated by a time-release membrane.

* * * * *